US006945189B1

(12) United States Patent
Garelick et al.

(10) Patent No.: US 6,945,189 B1
(45) Date of Patent: Sep. 20, 2005

(54) BOARDING LADDER MOUNTING APPARATUS

(75) Inventors: Richard J. Garelick, Minneapolis, MN (US); Charles J. Hauck, Inver Grove Heights, MN (US); Robert A. Riemenschneider, Oakdale, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 11 days.

(21) Appl. No.: 10/802,310

(22) Filed: Mar. 18, 2004

(51) Int. Cl.[7] ..... B63B 17/00

(52) U.S. Cl. ..... 114/362

(58) Field of Search ..... 114/362, 71.1; 182/64.1, 69.4, 237

(56) References Cited

U.S. PATENT DOCUMENTS

| | | | | | |
|---|---|---|---|---|---|
| 4,432,436 | A | * | 2/1984 | Suiter | 182/97 |
| 4,771,719 | A | * | 9/1988 | Chlebowski | 114/230.15 |
| 5,222,456 | A | * | 6/1993 | Friedrich | 114/362 |
| 6,021,733 | A | * | 2/2000 | Jaramillo, Sr. | 114/362 |
| 6,058,875 | A | * | 5/2000 | Krish, Jr. | 114/362 |

OTHER PUBLICATIONS

Garelick Product Catalog ™2001 pp. 6 and 7.

* cited by examiner

*Primary Examiner*—Stephen Avila

(57) ABSTRACT

A bracket is attachable to the side of a boat or dock and a latch is removably coupled to said bracket. The latch is pivotally attached to the upper end of a boat ladder so that the ladder can swing and can be adjustably angled with respect to the dock or boat when it is latched onto the bracket.

7 Claims, 4 Drawing Sheets

BOARDING LADDER MOUNTING APPARATUS

FIELD OF THE INVENTION

This invention is directed toward providing a mounting device for pivotably coupling a boat boarding ladder to a support structure such as a boat or a dock so that the ladder can be placed at an angle to the support structure and can swing with respect to the support structure if necessary. The ladder can be easily and readily coupled to or uncoupled from the mounting device.

DESCRIPTION OF THE PRIOR ART

There are a number of commercially available boat or dock boarding ladders which are releasably attachable to the side of a boat or a dock. They are especially useful for divers who may need to climb into the boat or on to the dock with a full load of diving gear. Some of these prior art boarding ladders have the conventional spaced-apart support members with steps held between the support members with the upper ends of the support members curved or hooked for grasping onto the gunwale or some other convenient part of the boat. Other commercially available boarding ladders may have a single centrally located support with the steps longitudinally spaced and extending outward from both sides of the support member with the upper end of the support member having a quick release attachment to a bracket which is attached to the side of the boat or dock. A more recent development is a compactable or foldable boat ladder which can be used for boarding purposes which has a pair of centrally located elongated supports with the steps or rungs pivotally engaged with the supports in such a fashion that by moving one of the supports longitudinally with respect to the other, the steps are swung outward for use or inward to compact the ladder for storage. In the past these also have had a quick release attachment to a bracket which is mounted on the side of the boat or dock. In all of these cases the ladder extends directly vertically downward from the bracket or generally parallel to the side of the boat or dock which sometimes makes it cumbersome or awkward for climbing into the boat or onto the dock. Further, if there is some heavy seas the waves impacting the boat can impact the ladder with a force that the ladder may be ripped away from its mounting to the boat or dock.

SUMMARY OF THE INVENTION

The present invention uses a bracket which is attached to the supporting structure such as the side of a boat or dock which provides for an easy attachment to and quick release from its attachment. The bracket has a front plate with a vertical slot for engaging a generally planar latching member. The latching member is pivotally engaged to the upper end of a boat boarding ladder so that the boarding ladder may be free to swing with respect to the side of the boat or dock while coupled to the mounting bracket so that if some relatively strong waves occur while the ladder is down the ladder can swing with respect to the boat or the dock while remaining attached, i.e., will less likely break away. As a further feature, the latching member has a cutout portion and an adjustable stop member is attached to the ladder support for resting against the cutout to hold the ladder at an angle with respect to the side of the boat or dock to make it more convenient to climb up, e.g., for a diver, with full dive gear. Yet a further feature is that the stop member can be adjustably positioned to change the angle at which the ladder rests to adjust to various boat transom angles, thereby avoiding the need to use shims.

DESCRIPTION OF THE PREFERRED EMBODIMENTS

Figure 1:
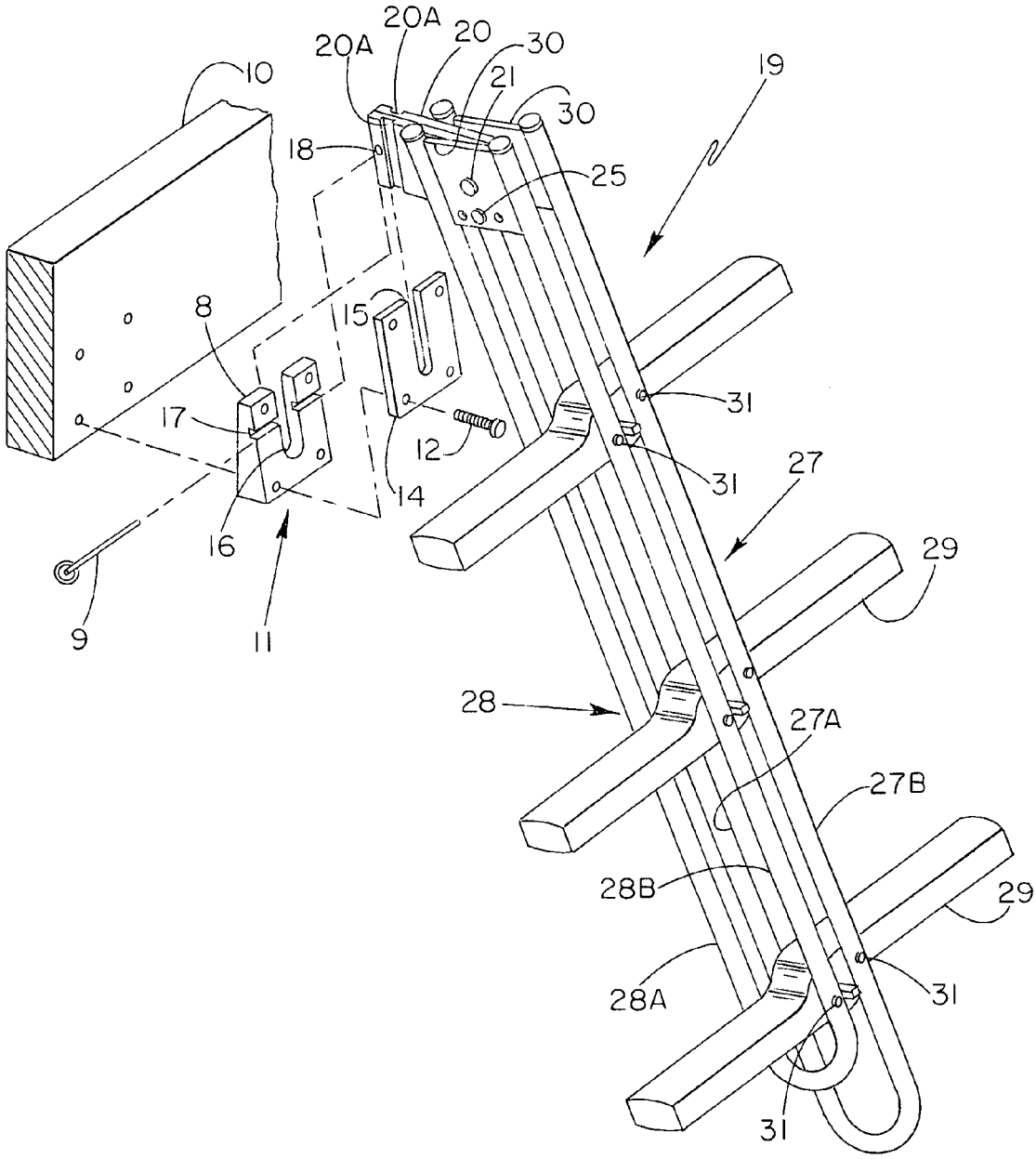
FIG. 1 is a perspective partly blown-apart view of a preferred embodiment of the invention.
Figure 2:
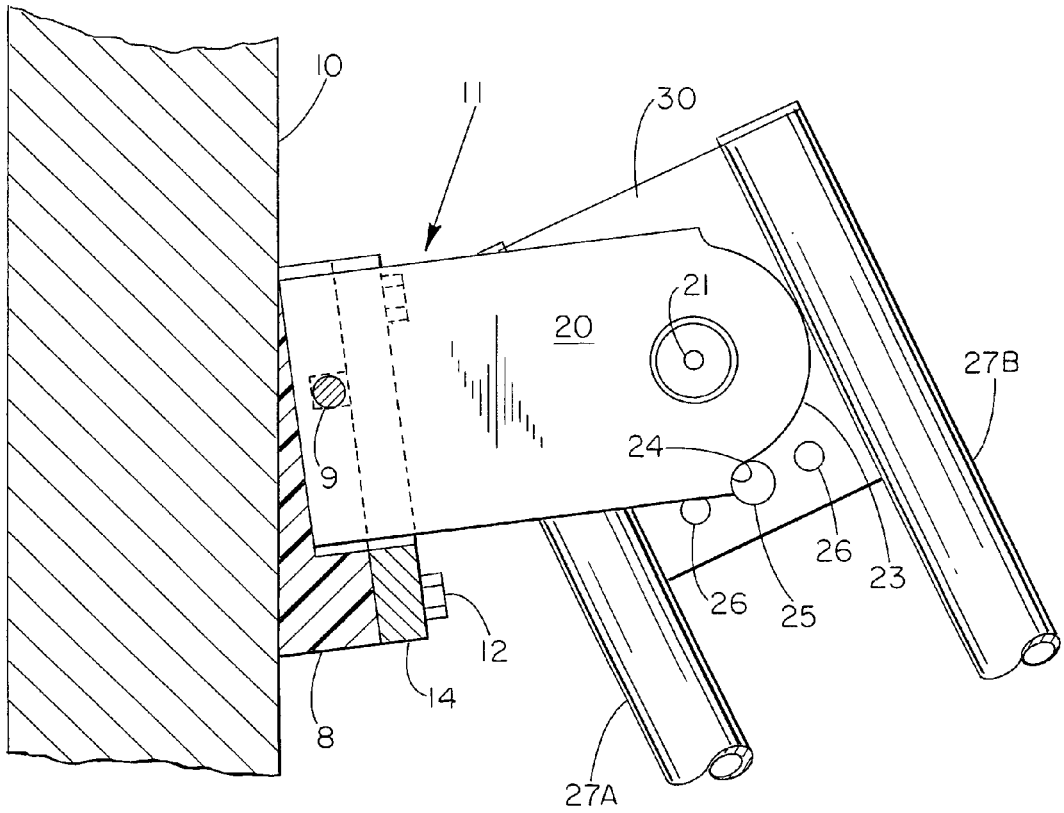
FIG. 2 is a sectional side view of the boarding ladder engaged with the mounting bracket.
Figure 3:
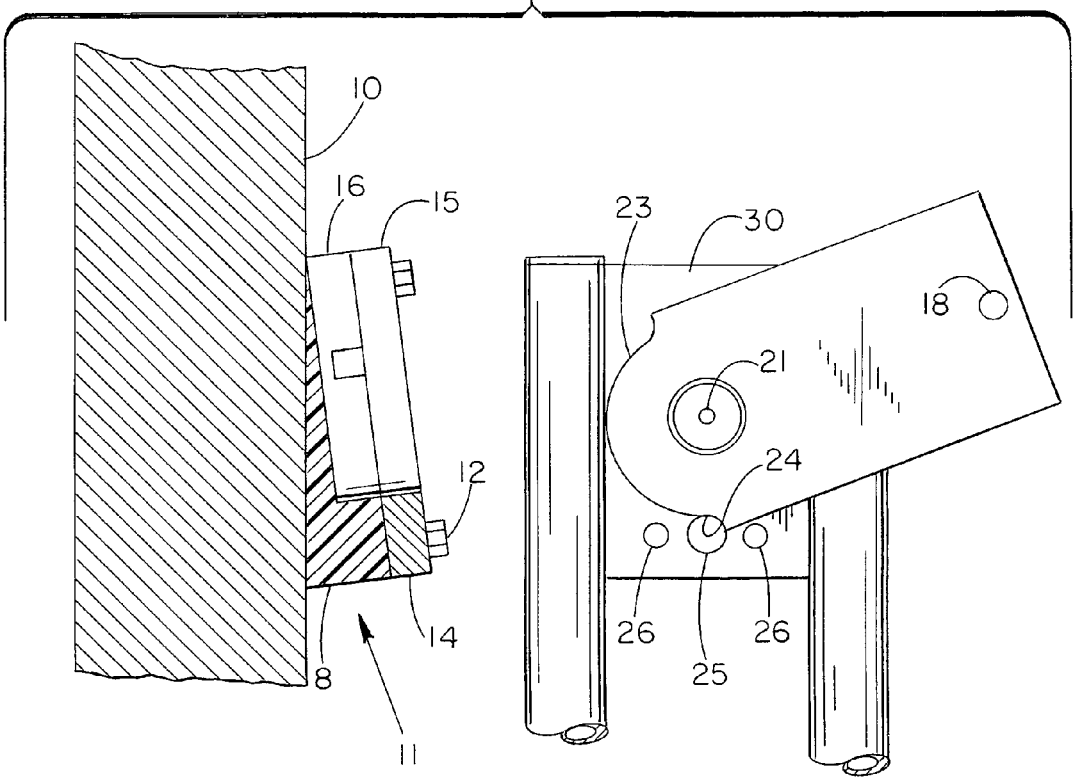
FIG. 3 is a view similar to FIG. 2 showing the boarding ladder disengaged from the mounting bracket.
Figure 4:
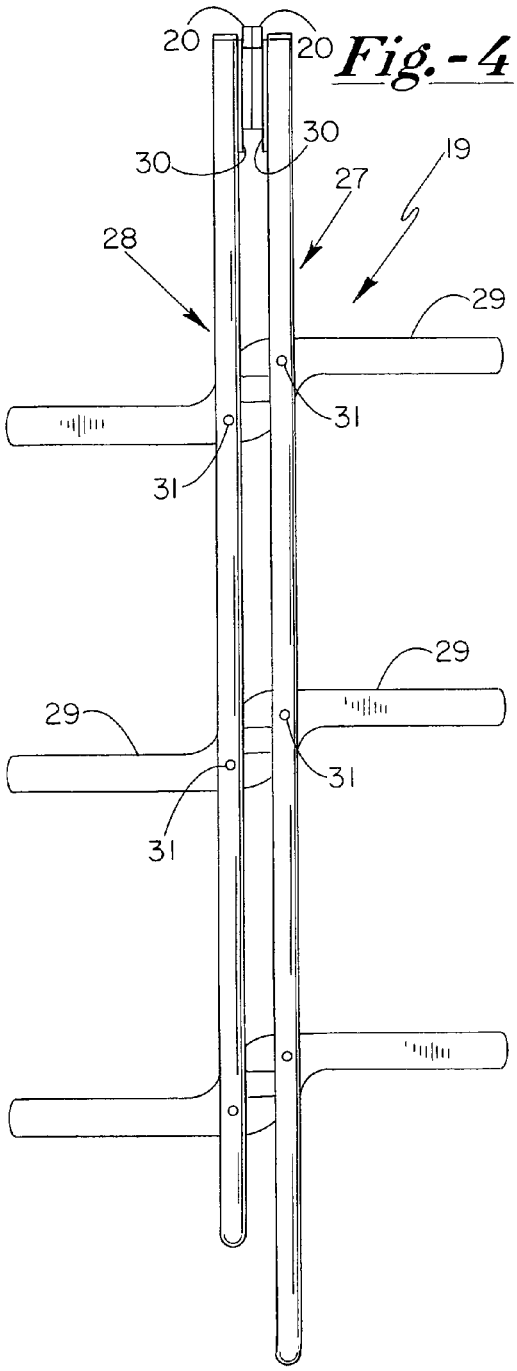
FIG. 4 is an illustration of a commercially available foldable compactable boat ladder for use with the mounting bracket.
Figure 5:
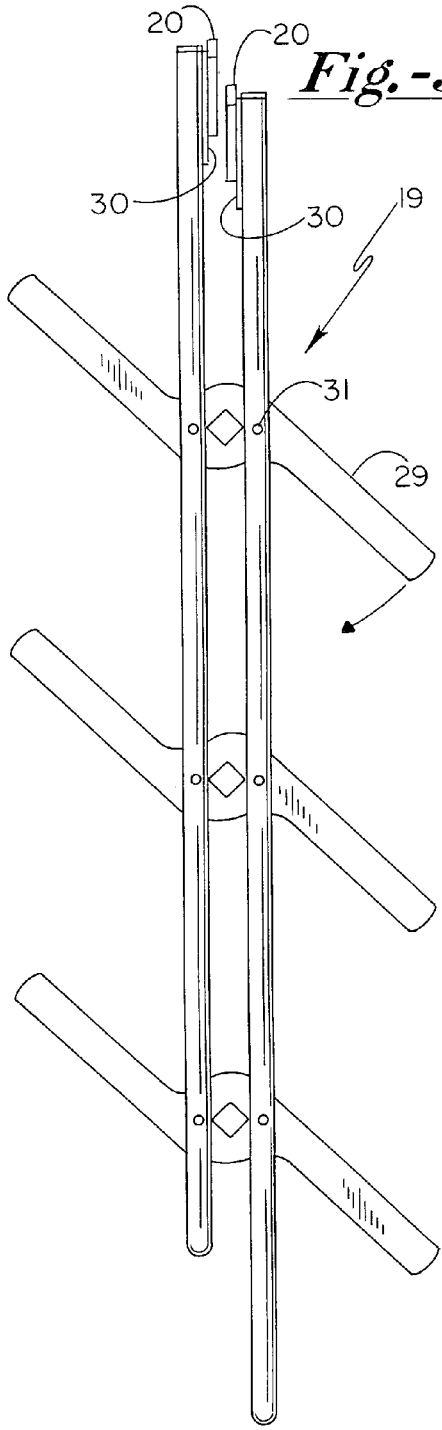
FIG. 5 illustrates the same ladder as in FIG. 4 unmounted and partially compacted or folded.

Mounted to the side of a boat or a dock 10 is a mounting bracket 11. Bracket 11 is secured to the boat or dock in some conventional fashion such as by bolts 12 with its back resting against the side of the boat dock 10. The bracket has a rearward section 8 with an open top elongated vertical recess 16 and a forwardly spaced front plate 14 which has a corresponding generally centrally located elongated vertical slot 15. A pair of planar vertically disposed latch plates 20 have vertical grooves 20A located toward their back or aft ends for slidably engaging slot 15 in bracket 11. When the latch plates 20 are inserted into slots 15 of bracket 11 a locking pin 9 may be inserted through a suitable cross slot 17 in bracket 11 to engage openings 18 in latch plates 20 to releasably lock latch plates 20 in place onto bracket 11.

The drawings illustrate the mounting apparatus used in conjunction with a foldable or compactable boat or dock loading ladder 19. This type of ladder is more clearly described in co-pending application Ser. No. 10/438,394 titled "COMPACTABLE BOAT LADDER" filed May 16, 2003. The ladder center support comprises a pair of centrally located elongated rigid tubular members 27 and 28. Preferably each of the ladder support members 27 and 28 comprises a pair of rigid tubes including a back member 27A and 28A and front member 27B and 28B, respectively. Ladder rungs or steps 29 are longitudinally spaced along the support members 27 and 28 and are pivotably attached to both the front and back members 27A and 27B and 28A and 28B at 31. The arrangement is such that when one of the support members is moved lengthwise with respect to the other support member the rungs or steps 29 are swung about their respective pivot points 31 to extend outward sideways from the support members 27 and 28 for use and when the support member is moved longitudinally in the opposite direction the steps swing inward to rest in the areas between the front and back members 27A and 27B and 28A and 28B so that the ladder is folded or compacted for storage. To use the mounting apparatus described hereinabove with a foldable or compactable ladder, a plate 30 is fixedly attached between the front and back members 27A and 27B and 28A and 28B of support members 27 and 28. Each plate 30 is pivotally attached at 21 to a corresponding latch plate 20 so that when the ladder is in the use position and latch plates 20 coupled to bracket 11, the ladder 19 is pivotally attached to bracket 11 and to the boat or dock 10.

Preferably the front ends or the outward edges of latching members 20 are arcuate as shown at 23 and at least one has a cutout at 24. A stop member 25, which may be in the form of a threaded bolt, may be threaded into at least one of the plates 30 and extend out to engage cutout 24. The plate 30 may have a series of partially threaded holes 26 for stop member 25 so it can be moved to different positions as desired. The point at which the stop member 25 strikes or rests against cutout 24 determines the angle at which ladder 19 rests with respect to the bracket 11 and therefore with respect to the boat or dock. Typically, stop member 25 may have three different mounting openings 26 which will locate the ladder at rest at those different angles with respect to the side of the boat or dock 10. The location of openings 26, and therefore the angle at which the ladder rests, is a matter of choice by the user. The pivotal attachment of the ladder to the dock or boat provides the benefit of being able to adjust the angle which the ladder makes with respect to the boat or dock for the convenience of the user. Also, if the ladder is down and there are some heavy waves or if attached to a boat and the boat moves, it allows the ladder to swing to protect against it being torn away from the boat or dock. Yet the ladder can be easily and fairly readily coupled to the mounting bracket for use and disengaged from the bracket for storage.

We claim:

1. Apparatus for mounting a boarding ladder to a support structure such as a dock or boat, comprising:

a) a mounting bracket having a back plate member for fixed attachment to a support structure;

b) said bracket having a front plate member resting against and attached to the front side of said back plate member said front plate member having a vertical slot;

c) a vertically disposed planar latch member releasably engaged with said front plate slot and extending forward from said front plate member; and d) a horizontally extending pivot pin attached to said latch member for pivotably engaging a boarding ladder support member at about its upper end to swingably couple the boarding ladder to said bracket.

2. Apparatus for mounting a boarding ladder to a support structure such as a boat or dock as described in claim 1 further including:

a cutout on said latch member and a stop member attached to said coupled ladder, said stop member engaging said cutout to hold the ladder at an angle with respect to said bracket.

3. Apparatus for mounting a boarding ladder to a support structure such as a dock or boat, comprising:

a) a mounting bracket having a back plate member for fixed attachment to a support structure;

b) said bracket having a front plate member resting against and fixedly attached to the front side of said back plate member, said front plate member having parallel top and bottom edges and vertical side edges and a vertical slot located between said side edges;

c) a vertically disposed planar latch member releasably engaged at about one end with said slot and extending forward from said bracket front plate member;

d) a boarding ladder having an elongated center support and longitudinally spaced steps attached to said support;

e) a pivot pin extending laterally between said latch and said ladder support remote from said one end of said latch member for pivotably coupling said latch member to said ladder support near its upper end for swingably mounting said ladder to said bracket.

4. Apparatus for mounting a boarding ladder to a support structure such as a boat or dock as described in claim 3 further including:

a cutout on said latch member and a stop member adjustably attached to the pivotally attached ladder support for engaging said cutout to hold the ladder at an angle with respect to said bracket.

5. Apparatus for mounting a boarding ladder to a support structure such as a dock or boat as described in claim 3 wherein:

said boarding ladder has a centrally located elongated rigid support and longitudinally spaced steps pivotally attached to said support for swinging outward from said support for use and inward for storage; and said pivot pin pivotably coupling said ladder support at about its upper end to said latch member.

6. Apparatus for mounting a boarding ladder to a support structure such as a boat or dock as described in claim 5 further including:

a cutout on said latch member and a stop member adjustably attached to said pivotally attached ladder support for engaging said cutout to set the ladder at an angle with respect to said bracket.

7. Apparatus for mounting a boarding ladder to a support structure as described in claim 6 further including:

a series of spaced-apart apertures on said ladder support for placing said stop member at different positions to change the angle at which the ladder sets.

* * * * *